US010086969B2

(12) United States Patent
De Coninck et al.

(10) Patent No.: US 10,086,969 B2
(45) Date of Patent: Oct. 2, 2018

(54) ARTICLE WITH ERGONOMIC INTEGRAL HANDLE

(75) Inventors: An De Coninck, Eppegem (BE); Christian Gerhard Friedrich Gerlach, St. Gilles (BE); Jean-Luc Azzani, Waterloo (BE)

(73) Assignee: The Procter & Gamble Company, Cincinnati, OH (US)

( * ) Notice: Subject to any disclaimer, the term of this patent is extended or adjusted under 35 U.S.C. 154(b) by 469 days.

(21) Appl. No.: 13/475,013

(22) Filed: May 18, 2012

(65) Prior Publication Data

US 2013/0270280 A1 Oct. 17, 2013

(30) Foreign Application Priority Data

Apr. 12, 2012 (EP) ..... 12163846

(51) Int. Cl.
*B65D 1/40* (2006.01)
*B65D 1/02* (2006.01)
*B65D 23/10* (2006.01)

(52) U.S. Cl.
CPC ..... *B65D 1/0223* (2013.01); *B65D 23/102* (2013.01)

(58) Field of Classification Search
USPC ..... 220/675, 755, 669, 771; 215/384, 398, 215/396
See application file for complete search history.

(56) References Cited

U.S. PATENT DOCUMENTS

| | | | | |
|---|---|---|---|---|
| 3,892,828 | A * | 7/1975 | Weatherly et al. | 264/515 |
| 4,368,827 | A | 1/1983 | Thompson | |
| 5,226,550 | A * | 7/1993 | Mikolaitis et al. | 215/384 |
| 7,770,752 | B2 * | 8/2010 | Gruskin et al. | 220/771 |
| 7,913,874 | B2 * | 3/2011 | Gruskin B65D | 25/2897 215/384 |
| 2008/0029475 | A1 * | 2/2008 | Scarola | 215/398 |
| 2009/0230084 | A1 * | 9/2009 | Yourist | 215/398 |
| 2009/0236776 | A1 | 9/2009 | Connolly et al. | |

FOREIGN PATENT DOCUMENTS

| | | | |
|---|---|---|---|
| DE | 88 06 145 | U1 | 7/1988 |
| EP | 2 103 413 | | 9/2009 |
| JP | 6056138 | A | 3/1994 |
| JP | 2006321568 | A | 11/2006 |
| WO | WO 2005/110861 | A1 | 11/2005 |
| WO | WO 2006/084214 | A1 | 8/2006 |

OTHER PUBLICATIONS

International Search Report for Application Serial No. PCT/US2012/034849, dated Jun. 1, 2012, 11 pages.

* cited by examiner

*Primary Examiner* — Robert Poon
(74) *Attorney, Agent, or Firm* — Gary J. Foose

(57) ABSTRACT

The invention relates to a molded article with a body having a top and a bottom; an opening proximal to the top; and a handle integrally located on at least one side of the body and positioned between the top and the bottom. The handle having at least one innermost surface, one external surface and at least one transition surface positioned between the innermost surface and the external surface, the handle forming at least one semi-enclosed recess positioned between the external surface and the body.

5 Claims, 8 Drawing Sheets

ARTICLE WITH ERGONOMIC INTEGRAL HANDLE

FIELD OF INVENTION

The present invention relates to articles comprising an integral handle, more particularly a non-through-handle, having optimal ergonomics to provide comfort and ease of use whilst being simple and economic to manufacture.

BACKGROUND OF THE INVENTION

The formation of integral handles onto molded articles is highly desirable and the art contains a number of attempts to solve the inherent problems posed by such handles, some more successful than others. An integrally molded handle is generally less expensive to manufacture and more sustainable compared to, for example a clip-on handle. A number of approaches to generate such handles have been disclosed, the most successful being the generation of opposing depressions or cavities in the body of the articles to form the structural basis of the handle. The depressions can either then be welded together and the central section, encompassed by the weld, can be removed such as to form a completely open space through which the fingers and/or thumb can be inserted (a "through" handle), or, alternatively, left to simply form a grip (a "non-through" handle).

A number of studies have been done on improving the ergonomics of integral handles. In particular, to generate integral handles having ergonomic designs comparable to those of "through" handles, without having the costly manufacturing step of removing the weld and other drawbacks, such as material costs and the logistical costs associated with transporting articles comprising such "through" handles.

One approach has been to essentially remove the surface of the handle which normally would come into contact with the user's palm of the hand, such to generate two hooks opposite and spaced apart from each other. The user, would therefore grip the upper hook with his/her thumb and index fingers, and the lower hook with the little finger. An example of such approach is illustrated in U.S. Pat. No. 4,368,827. Disadvantages of such approach will be apparent to a person skilled in the art, indeed, not only does this configuration provide excess strain to the user's wrist and discomfort to the user's fingers, that will bear the whole weight of the article, but also production line disadvantages whereby multiple bottles could hook with each other with the need of some kind of intervention to separate them.

A more successful approach has been to generate a "non-through" handle via a process that comprises a deformation step wherein inwardly moving plugs generate depressions in the container body to form the integral handle. Two opposite and spaced apart recessed regions are generated to accommodate a user's fingers. An example of such an approach is illustrated in WO2006/084214. This approach, although providing advantages towards manufacturing and logistical costs, still lack the required ergonomics.

An attempt to solve such problem, has been to adapt the abovementioned processes in order to generate a "non-through" handle having a predetermined grip design, with particular focus on the grip perimeter of the holding means. An example of such approach is illustrated in EP2103413. However, there still remains a need for articles having "non-through" handles with optimized ergonomics in order to achieve the comfort of a "through" handle whilst attaining the many advantages of a "non-through" handle.

It is an objective of the present invention to provide an article comprising an ergonomic "non-through" handle having the grip advantages of a "through" handle. In particular, an integral handle that allows the user to comfortably pick up the article with at least the thumb and index fingers and subsequently transition to a full grip position without changing position of the fingers used in the pick-up motion and without creating uncomfortable pressure points onto the user's hand.

It is a further objective of the present invention to achieve such transition and still permit rotation of the article upon dispensing of the content whilst limiting strain onto the user's hand and wrist.

SUMMARY OF THE INVENTION

The present invention relates to a molded article comprising a body having a top and a bottom; an opening proximal to said top; and a holding means integrally located on at least one side of said body and positioned between said top and said bottom. The holding means comprising at least one innermost surface, one external surface and at least one transition surface positioned between said innermost surface and said external surface, said holding means forming at least one semi-enclosed recess positioned between said external surface and said body. Wherein, the cross-section of said holding means is rounded such that a radius "r" is formed between said transition surface and said external surface, said radius "r" being greater than 7.5 mm, and wherein the largest width "w" of said holding means is between 50 mm and 60 mm, said holding means comprising a top surface extending at an angle "a" of greater than or equal to 50°.

DETAILED DESCRIPTION OF THE INVENTION

Figure 1A:
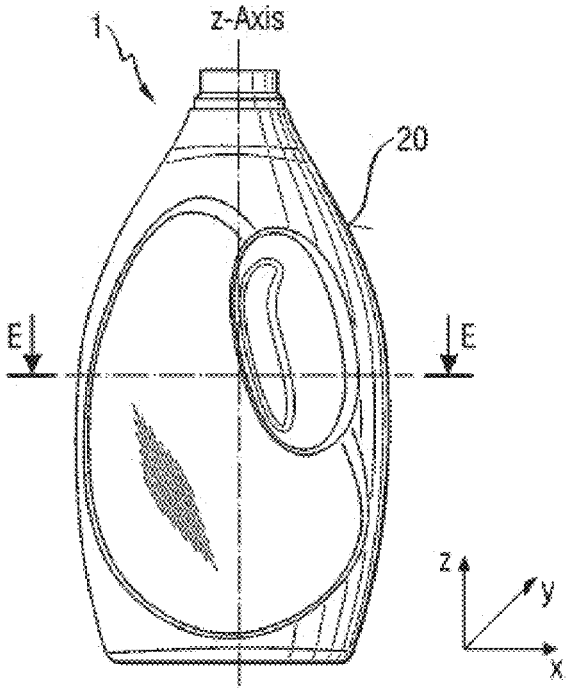
FIG. 1A is a side view of the article according to one embodiment of the present invention.

The term "ergonomics or ergonomic" as used herein means that the feature, or plurality of features interacting with each other, is/are designed to minimize effort and discomfort for the user.

The "z-axis" as used herein is the centerline of the article.

The "x-axis" as used herein is perpendicular to the z-axis and substantially parallel to the axis crossing both holding means and body of the article.

The "x-y" plane as used herein is the plane substantially perpendicular to the z-axis.

The "x-z" plane as used herein is the plane substantially parallel to the z-axis and having one side substantially parallel to the axis crossing both holding means and body of the article.

The term "rounded cross-section" as used herein is a cross-section devoid of any sharp edges and having a continuous and smooth profile.

The term "concave" as used herein means that the surface is arched inwardly (or towards the z-axis) to form a rounded surface devoid of sharp edges.

The term "non-through handle" as used herein is a handle forming at least one semi-enclosed recess onto at least a portion of the article.

The term "semi-enclosed recess" as used herein is a recess having only one opening and being closed on all other sides. Said opening extending from the innermost surface of the holding means of the article in a direction orthogonal thereto.

The term "integral or integrated" as used herein means that the features or elements referred to form a single part. Such features and elements are also formed as a single part.

The term "gripping or grip position" refers to the position of the hand which allows the user to apply a rotation about an axis substantially perpendicular to the z-axis.

The term "pick-up or picking up position" refers to the position of the fingers when the user picks up the article in a direction substantially parallel to the z-axis against the force of gravity. In this position the user comfortably places at least two fingers (typically the thumb and index finger) onto at least one portion of the integral holding means. The at least one portion is typically the upper end of the holding means.

The term "primary grip position" as used herein, refers to the position on the holding means of the article which coincides with the location of the user's index and thumb position when gripping said holding means. Said primary grip position is located proximal to the upper end of the holding means.

The term "preform" as used herein is a molded element which is produced prior to expansion to form the finished article. A preform is necessarily somewhat smaller than the finished blown article. A preform is generally produced by, for example injection molding, at an elevated temperature in excess of the melt temperature.

The term "stretch-blow molding" as used herein is the process in which preforms are heated above their glass transition temperature, and then blown in molds using a high pressure medium, preferably air, to form hollow articles, such as containers. Usually the preform is stretched with a stretch rod as part of the process.

As used herein "recycled" materials encompass post-consumer recycled (PCR) materials, post-industrial recycled (PIR) materials, and mixtures thereof.

As used herein "regrind" material is thermoplastic waste material, such as sprues, runners, excess parison material, and reject parts from injection and blow molding and extrusion operations, which has been reclaimed by shredding or granulating.

As used herein the prefix "bio-" is used to designate a material that has been derived from a renewable resource.

The invention is directed to a blow molded article comprising an ergonomic integral handle, more particularly a non-through-handle.

The Article

Articles according to the present invention may be selected from the group consisting of containers, devices, handles, implements and combinations thereof. Preferred articles are containers for use in a variety of fields. Non-limiting examples of such fields are; beauty care products, such as containers for body wash, shampoos and conditioners; domestic and/or household products, such as containers for detergents or other cleaning preparations for cleaning and/or conditioning fabric and/or hard surfaces; oral care products, such as containers for mouth wash; and so on.

Preferred containers are those sized to contain at least 1.5 liters, preferably at least 2 liters, more preferably between 2 liters and 5 liters, even more preferably between 2 liters and 4 liters, most preferably between 2 and 3 liters, of a substance selected from the group consisting of a liquid composition, solid composition, gel composition, and mixtures thereof. Preferably, said compositions are detergent compositions.

Articles according to the present invention can be made of any suitable plastic resin material. Preferred plastic resin materials for use in the present invention can be polyolefins (such as PP and PE), polystyrene (PS), polyvinyl chloride (PVC), polylactic acid (PLA) or polyethylene terephthalate (PET). In one embodiment, the plastic resin material is polyethylene terephthalate (PET). Alternatively, articles according to the present invention may be made of sustainable materials selected from the group consisting of renewable materials, recycled materials, regrind materials, and mixtures thereof.

Examples of "renewable materials" include bio-polyethylene, bio-polyethylene terephthalate, and bio-polypropylene. As used herein and unless otherwise stated, "polyethylene" encompasses high density polyethylene (HDPE), low density polyethylene (LDPE), linear low density polyethylene (LLDPE), and ultra low density polyethylene (ULDPE). As used herein and unless otherwise stated, "polypropylene" encompasses homopolymer polypropylene, random copolymer polypropylene, and block copolymer polypropylene.

Figure 1B:
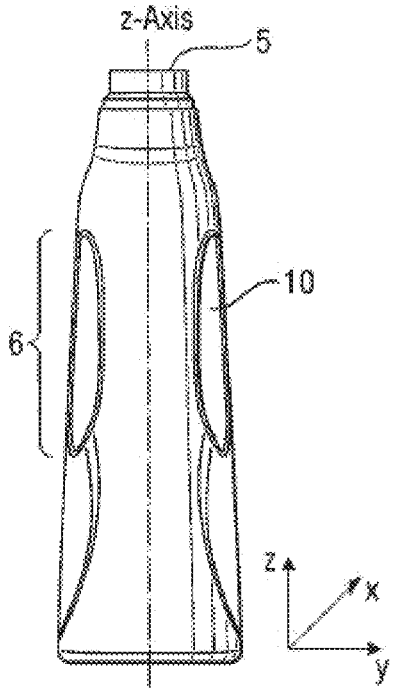
FIG. 1B is a back view of the article according to one embodiment of the present invention.
Figure 1C:
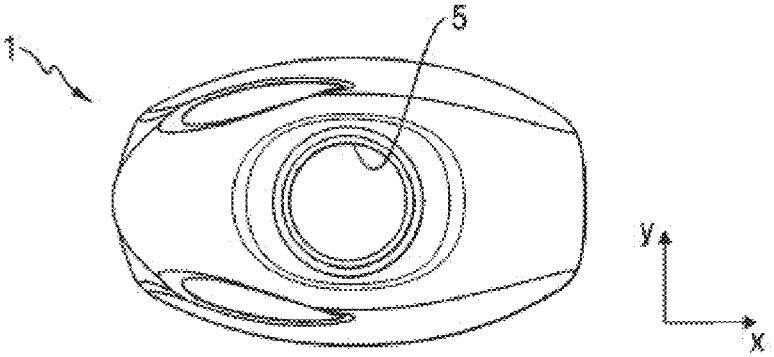
FIG. 1C is a top view of the article according to an embodiment of the present invention.
Figure 2:
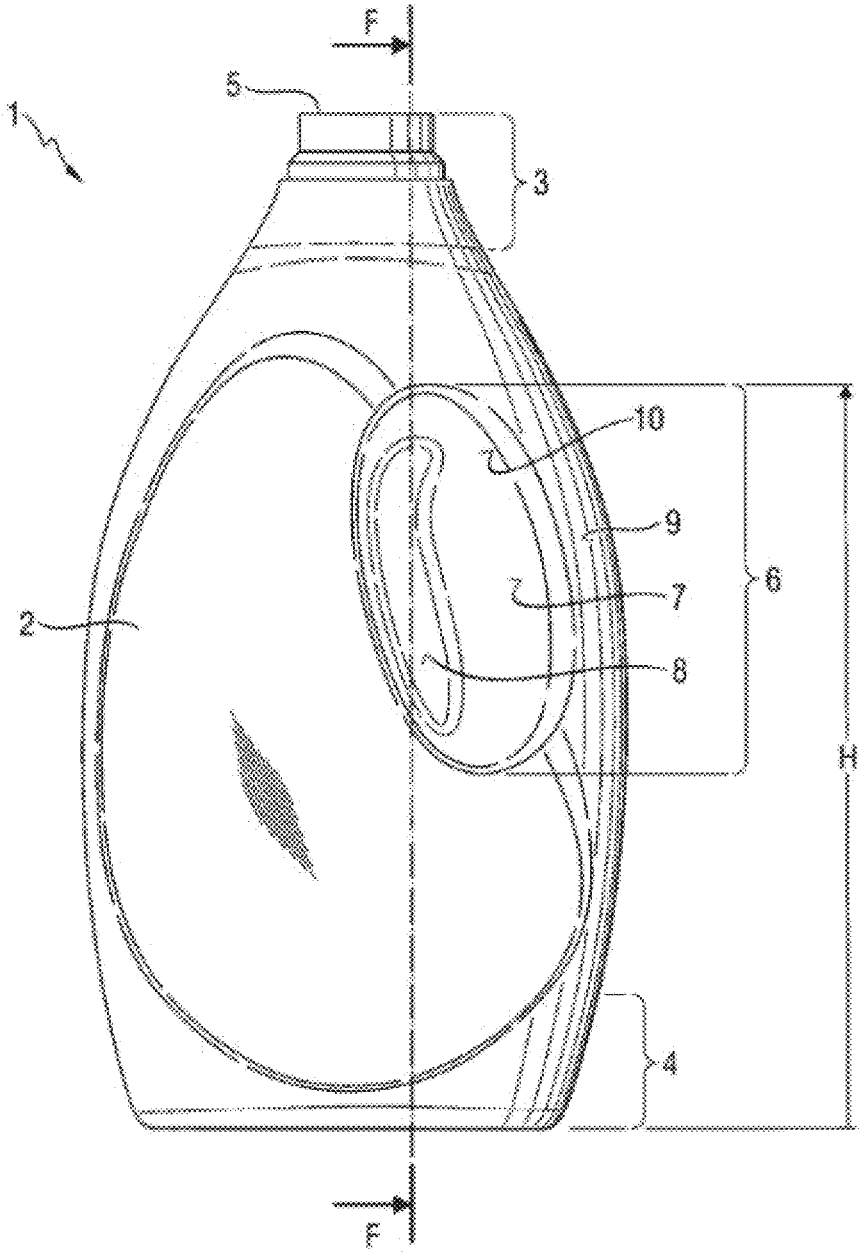
FIG. 2 is the side view of the article, according to an embodiment of the present invention, illustrating details of the holding means and primary grip position.

Referring to FIGS. 1*a*, 1*b* and 2, articles (1) according to the present invention comprise: a body (2) having a top (3) and a bottom (4); an opening (5) proximal to said top (3); and a holding means (6), typically ergonomic, integrally located on at least one side of said body (2) and positioned between said top (3) and said bottom (4). The holding means (6) comprising at least one innermost surface (8), one external surface (9) and at least one transition surface (7). The transition surface (7) is positioned between the innermost surface (8) and the external surface (9). The holding means (6) forming at least one semi-enclosed recess (10) is positioned between the external surface (9) and the body (2).

Figure 3A:
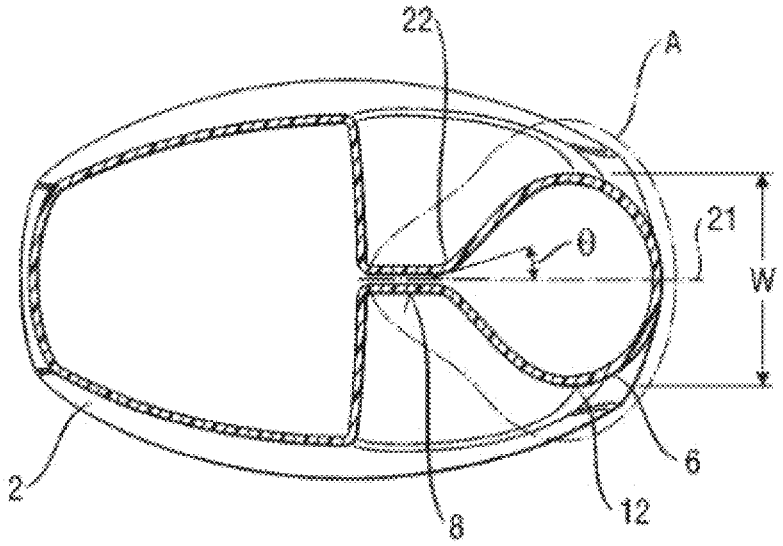
FIG. 3A is a top cross-section view taken from line EE of FIG. 1A.
Figure 3B:
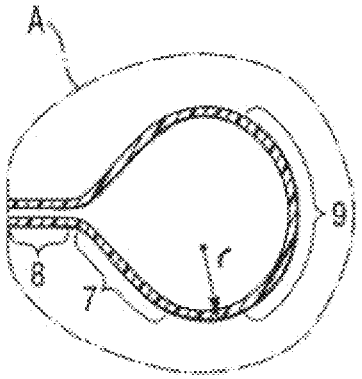
FIG. 3B is an enlargement of section A of FIG. 3A.

Referring to FIG. 3*b*, the cross-section of the holding means (6) is rounded such that a radius "r" is formed between the at least one transition surface (7) and the external surface (9), the radius "r" being greater than 7.5 mm, preferably greater than 10 mm, more preferably greater than 15 mm, even more preferably greater than 18 mm, and most preferably between 10 mm and 20 mm. Such radius "r" contributes to comfortable gripping of the holding means (6) by a user and aids transitioning from article pick-up to article gripping positions. Without wishing to be bound by theory, it is believed that introducing such radius allows to reduce the pressure points generated onto the user's hand thus improving grip comfort and ease of said transition.

Referring to FIG. 3*a*, the largest width "w" of the holding means (6) is between 50 mm and 60 mm, preferably between 50 mm and 55 mm. Such width "w" contributes to comfortable gripping of the holding means (6) by a user. Without wishing to be bound by theory, it is believed that the largest (or maximum) width of the holding means (6) is important to permit the user to handle the article in a natural and non-tiresome manner. If the maximum width were too small, the contact area in the holding means (6)/user's palm interface would be limited and the user's fingers would be prevented from firmly griping the holding means (6) which may result in induced strain onto the user's wrist. On the other hand, if too large, the user would experience excessive strain onto the fingers. It is further believed that a maximum width of greater than 60 mm would render the transition between picking up the article and gripping the article more strenuous. This inevitably also impacts the amount of weight that the consumer can pick up and therefore the size of the article and its contents.

Figure 4:
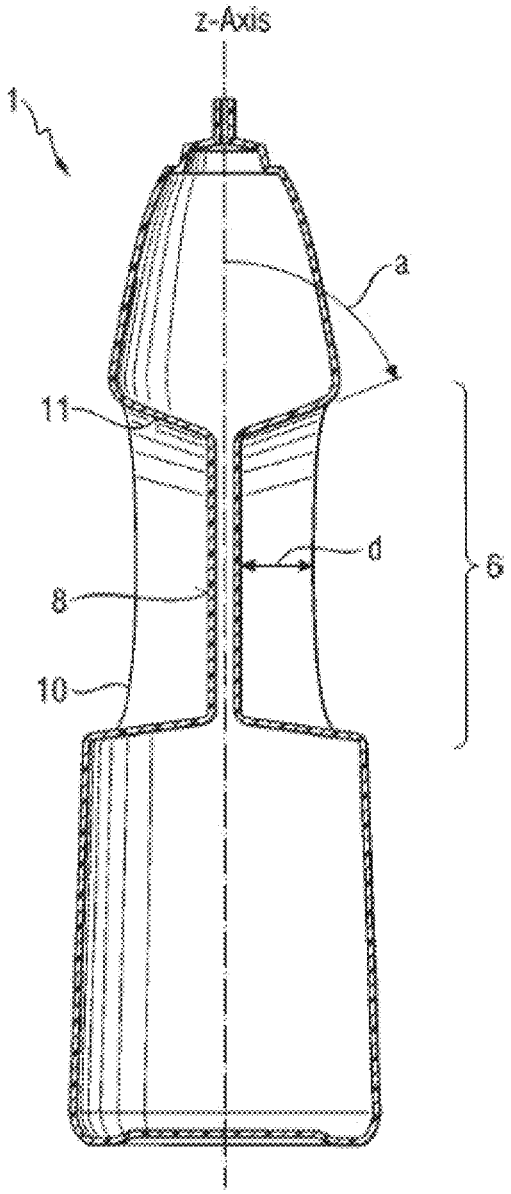
FIG. 4 is a cross-section taken along line FF of FIG. 2.

Referring to FIG. 4, the holding means (6) comprises a top surface (11) extending at an angle "a" of greater or equal to 50°, preferably greater than or equal to 60°, more preferably greater or equal to 70°, most preferably greater or equal to 75°, taken from, and/or about, the axis crossing the top (3) and the bottom (4) of the body (2) (i.e. the z-axis). Typically, the angle "a" is measured from the top of said axis, being proximal to the top (3) of the body (2) and distal to the bottom (4) of the body (2). Without wishing to be bound by theory, it is believed that a sufficiently inclined top surface (11) allows the user to secure and hook onto a portion of said surface (11) and at the same time provide the necessary support that reduces the amount of pressure required to be exerted by the user's fingers. If however, the inclination is too high (i.e. at low "a" angles) the user's fingers will tend to slip resulting in a greater pressure required to be applied in order to pick up the article.

Referring to FIGS. 3*a* and 4, the holding means (6) may have at least one, preferably at least two, innermost surfaces (8) which extend substantially parallel to the axis crossing both holding means (6) and body (2) and/or extend substantially parallel to the axis crossing both top (3) and bottom (4) of the body (2). In a preferred embodiment, the holding means (6) comprises two innermost surfaces (8) each extending substantially parallel to the axis crossing both holding means (6) and body (2), and extending vertically substantially parallel to the axis crossing both top (3) and bottom (4) of the body (2).

In a preferred embodiment, the holding means (6) is dimensioned such that the user can grasp the article (1) without his/her fingers touching the innermost surface (8) of the holding means (6). In an embodiment the distance "d" between the apex of the innermost surface (8) and a distal end (12) on said external surface (9) is between 0 mm and 60 mm, preferably between 10 mm and 50 mm, more preferably between 15 mm and 40 mm, even more preferably between 20 mm and 35 mm, even more preferably between 20 mm and 30 mm, even more preferably between 25 mm and 29 mm, most preferably between 20 mm and 27 mm. This configuration allows for the largest possible depth being generated such that the user's fingers are prevented from pushing onto the innermost surfaces (8), thus achieving the comfort benefit of a through handle. Without wishing to be bound by theory, it is believed that such configuration enables the user to apply a comfortable and powerful grip which in turn enables pick-up and gripping of larger and/or heavier articles.

Referring to FIG. 2, the holding means (6) may comprise a primary grip position (13). The primary grip position (13) is at a height "H" which is between 1.3 to 1.6, preferably 1.4, times the height of the centre of gravity, measured at filled conditions, taken from the bottom (4) of the body (2). By "filled conditions" we herein mean that between 85% and 95%, preferably between 88% and 93%, more preferably between 90 and 93%, of the total article internal volume is filled by the liquid contained therein. This configuration allows for the axis of rotation of the article (1), during the dispensing motion generated by the user, to be as close as possible to the centre for gravity of said article (1) in filled and/or semi-depleted conditions. This in turn introduces wrist strain advantages since the user's wrist will not experience additional torques that may be generated if the centre of gravity is offset from the axis of rotation, particularly when the article is at its heaviest. Without wishing to be bound by theory, it is believed that this configuration ensures that any torque is reduced and even substantially eliminated, which in turn means that the only substantial force the user's wrist experiences is that generated by the weight of the article.

Figure 5:
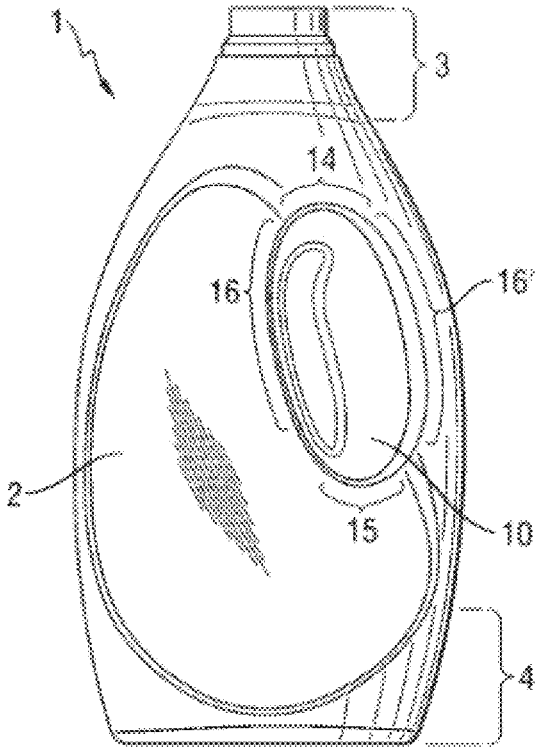
FIG. 5 is a side view of the article, according to one embodiment of the present invention, illustrating parts of the holding portion.

Referring to FIG. 5, the holding means (6) may comprise an upper end (14), a lower end (15), and two side ends (16, 16'). The upper end (14) may be located proximal to the top (3), and the lower end (15) located proximal to the bottom (4) of the body (2) of the article (1). The two side ends (16, 16') may be spaced apart to form the opening of the semi-enclosed recess (10).

Figure 3C:
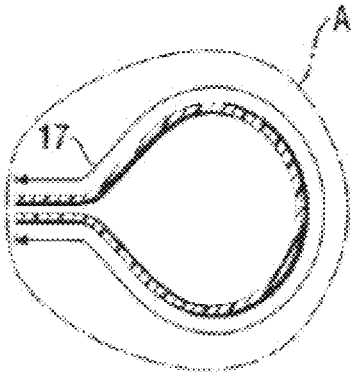
FIG. 3C is an enlargement of section A of FIG. 3A to illustrate the total grip circumference.

Referring to FIGS. 3*a* to 3*c*, the holding means (6) may have a total grip circumference (17) formed by the sum of all innermost, external and transition surfaces (7, 8, 9). In an embodiment, the grip circumference (17) is measured along a plane extending substantially parallel to the axis crossing both the holding means (6) and body (2). Preferably said total grip circumference (17) is at least 190 mm, preferably greater than 196 mm. Without wishing to be bound by theory, optimum holding means (6) ergonomic geometry is dependent on the three-dimensional characteristics of the semi-enclosed recess (10). It has been found that the grip circumference (17) ultimately defines the essential geometry in a single dimension. If the grip circumference is below 190 mm, the natural holding position of the user will be distorted and the fingers of the user would most likely conflict with at least one surface of the side ends of the holding means.

Figure 6:
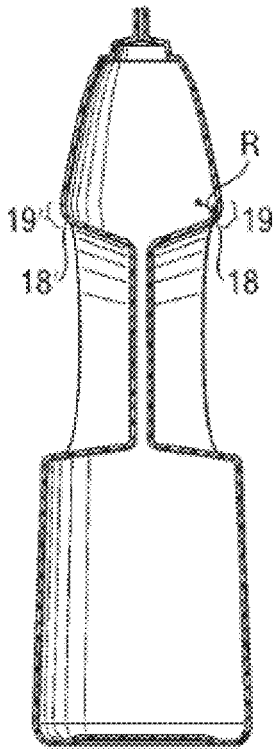
FIG. 6 is a cross-section taken along line FF of FIG. 2, illustrating the outermost ends of the top surface of the holding means and the top surface edges.

Referring to FIG. 6, the top surface (11) may comprise at least one, preferably two, outermost end (18). In an embodiment the top surface (11) comprises two outermost ends (18, 18') axially displaced along an axis (parallel to the y-axis) perpendicular to both the axis crossing the top (3) and bottom (4) of the body (2) and the axis crossing the holding means (6) and the body (2). The outermost ends (18, 18') may be positioned such that the distance from said top (3) and/or said bottom (4) is the same for both said outermost ends (18, 18'). In an embodiment, said outermost ends (18, 18') form top surface edges (19, 19') on the upper end (14) of the holding means (6). In an embodiment, said top surface edges (19, 19') are shaped to form a radius "R" of less than or equal to 15 mm, preferably less than or equal to 10 mm, more preferably greater than 0 mm and less than 10 mm, even more preferably between 2 mm and 4 mm. Such embodiment has the advantage of providing an edge generating support onto at least a portion of the user's knuckle onto which some of the load of the article is transferred. Without wishing to be bound by theory, it is believed that such support allows to reduce the amount of pressure to be exerted by the fingers and thus contribute to the overall grip comfort. It is also believed that such edge contributes in generating a hook that aids article pick up. It is further believed that such edge contributes in providing a visual perception of the ergonomic feature.

In a preferred embodiment, the semi-enclosed recess (10) may be elongate in shape. The semi-enclosed recess (10) may have a height of at least 90 mm taken along the longest length (or dimension) thereof. The advantage of this configuration is that more room for the hand is allowed such that as the contents of the article is depleted, and the centre of gravity changes, the position of the hand can be shifted in order to re-position it closer to the new centre of gravity without substantial detriment to the ergonomic benefits of the holding means (6).

Referring to FIGS. 1*a* and 2, the holding means (6) may comprise at least one convex surface (20), preferably following a substantially continuous arched profile, formed on and/or along at least part of the external surface (9), extending at a first angle in a first region proximal to the bottom (4) of the body (2) and at a second angle in a second region proximal to the top (3) of the body (2). Preferably, the first angle is greater than the second angle, taken clockwise from an axis substantially parallel to the axis crossing both the holding means (6) and the body (2). The first angle may be between 80° and 95°, preferably between 85 and 90°, more preferably 90°, and the second angle is between 45° and 90°, preferably between 65° and 85°, preferably between 60° and 80°, more preferably between 70° and 75°, more preferably 75°. In this embodiment, the convex surface (20) generates an angled profile that provides the correct support to the user's palm of the hand upon rotation for dispensing and also eases transition from the pick-up position to the grip position.

Referring to FIGS. 3*a* and 3*b*, the holding means (6) may be symmetric about a line of symmetry (or axis of symmetry) (21) extending parallel to an axis crossing both holding means (6) and body (2). The transition surface (7) may form at least one concave portion (22), and optionally, the angle θ between the concave portion (22) and the axis of symmetry (21) is between 35° and 60°, preferably between 40° and 50°, and most preferably 45°. In this embodiment, the holding means (6) preferably comprises two semi-enclosed recesses (10) and two innermost surfaces (8), each being mirrored about the axis of symmetry (21).

Figure 7:
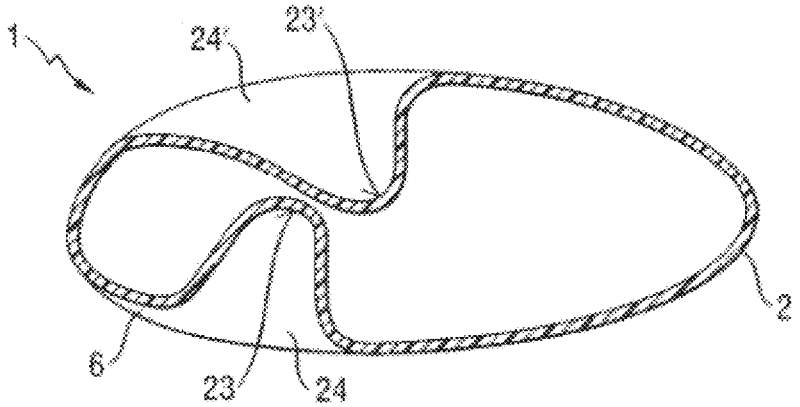
FIG. 7 is a top cross-section taken along a line parallel to the x-axis of an article according to an embodiment of the present invention.

Referring to FIG. 7, the holding means (6) may be asymmetric and comprise two innermost surfaces (23, 23') and forms two asymmetric semi-enclosed recesses (24, 24') positioned such that the apex of the two innermost surfaces (23, 23') are axially displaced in a direction parallel to an axis crossing both the holding means (6) and the body (2). The two innermost surfaces (23, 23') may be axially displaced in a direction parallel to the axis crossing both the holding means (6) and the body (2) and/or to an axis perpendicular thereto. Such configuration allows to generate a holding means (6) with greater recess depth to provide the ergonomic benefits equivalent to a through handle, in that the user is able to essentially wrap its fingers around the holding means (6) although there is no aperture leading from one semi-enclosed recess to the other. A further benefit is that in such configuration the user may rest the upper end (14) of the holding means (6) on all the finger and knuckle upper surface, thus providing a greater surface area of contact which results in less gripping effort required by the user.

In a preferred embodiment (not shown) the article comprises more than one, preferably two, asymmetric holding means, preferably wherein one of said asymmetric holding means is a non-superposable mirror image of the other. In a preferred embodiment the asymmetric holding means are located on two opposite ends of the article. Alternatively, the asymmetric holding means may be positioned one on top of the other. Alternatively, the asymmetric holding means may be positioned such that the above mentioned positions are combined. These configurations have the advantage of permitting a user to grasp the article with either left or right hand and/or with both hands simultaneously. This becomes particularly desirable for articles typically larger than 3 liters.

In a preferred embodiment, at least one segment of said holding means (6) is textured such to provide a non-slip surface for the user's fingers. In an embodiment, at least a portion of the innermost surface (8), and/or the external surface (9), and/or said transition surface (7), is textured such to provide a non-slip surface. The texture may be provided by a physical feature increasing the surface area of contact, such as ribs, and/or a change in the in the properties of a surface, such as adhesion of a suitable substrate, shrink sleeve, labels with and without tactile surfaces, direct object printing and combinations thereof.

In a preferred embodiment, the article (1) comprises indicia (not shown) located proximal to the holding means (6) providing a visual indication of the location of the ergonomic features of said holding means (6). Suitable indicia may be selected from the group consisting of coloration, surface texture, labeling, shrink sleeves, and combinations thereof. A preferred indicia is coloration, selected from the group of bulk coloration, such as dye and/or pigment and/or colorant in the resin; direct object printing coloration; and combinations thereof. Without wishing to being bound by theory it is believed that perceived ergonomics is an important factor in determining the success of an ergonomic feature. It has been found that a visual support of the tactile benefits of the feature, in combination with its shape, triggers a better consumer response. Another benefit is that the user can quickly identify the portions of the holding means (6) to be grasped.

The Process

Articles according to the present invention may be made by any suitable process, such as blow molding, thermoforming, injection molding, and combinations thereof. Preferably, articles of the present invention are made by a blow molding process.

Blow molding is a well known manufacturing process for the fabrication of plastic articles such as containers, fuel tanks, handles etc. The blow molding process begins with melting down plastic and forming it into a parison or preform. The parison or preform is then clamped into a mold and a pressurized medium, usually air, is blown or pumped into it. The air pressure forces the plastic to match the peripheral geometry of the mold. Once the plastic has cooled and hardened the mold opens up and the part is ejected.

There are three main types of blow molding platforms: extrusion blow molding (EBM), injection blow molding (IBM) and stretch blow molding (SBM). In some applications the combination of the abovementioned blow molding platforms may be more appropriate depending on the properties and complexity of the articles to be formed, such as injection stretch blow molding (ISBM).

In a preferred embodiment, articles according to the present invention are formed by extrusion blow molding, injection blow molding, stretch blow molding and combinations thereof, preferably by injection stretch blow molding.

A suitable process to generate articles according to the present invention is described in US2009/0236776, published on 24 Sep. 2009, (paragraphs 0034 to 0052) incorporated herein by reference.

Ergonomic Evaluation of "Non-Through" Handles Having Varying Width "w"

Figure 8:
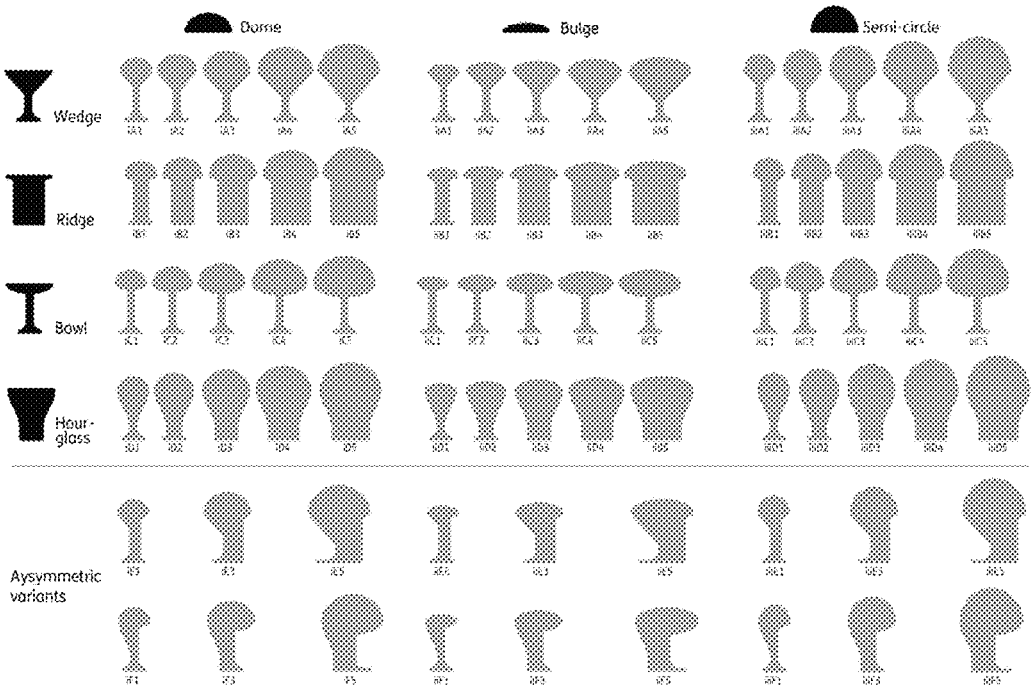
FIG. 8 illustrates symmetrical and asymmetrical "non-through" handle shapes for ergonomic evaluation.

Symmetrical and asymmetrical "non-through" handles are prepared, 60 symmetric and 18 asymmetric in total, by sintering process with PA (Poly Amide) and filling with plaster. Out of the 60 symmetric handles, a total of 12 different shapes are made (as illustrated in FIG. 8). For each of the 12 different shapes, 5 different sizes are made, wherein the width "w" is varied. The width "w" for each shape being 40 mm, 50 mm, 60 mm, 70 mm, or 80 mm. Similarly, out of the 18 asymmetric handles, a total of 6 different shapes are made (as illustrated in FIG. 8). For each of the 6 different shapes, 3 different sizes are made, wherein the width "w" is varied. The width "w" for each shape being 40 mm, 60 mm, or 80 mm. All handles are weighed to 669 grams (±19 g) and covered in white plastic sheeting to replicate the texture of a PET bottle.

Figure 9:
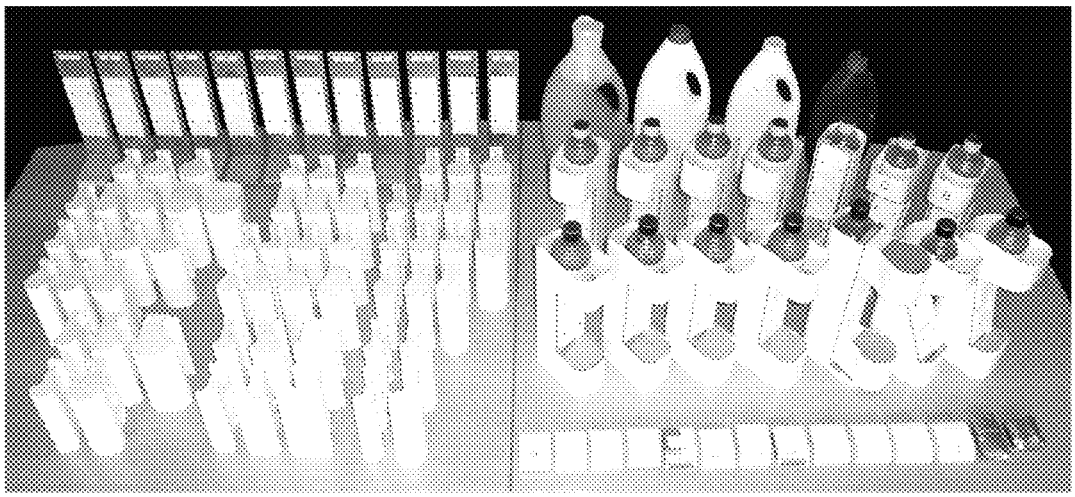
FIG. 9 illustrates symmetrical and asymmetrical "non-through" handle test rigs for ergonomic evaluation.

Adjustable test rigs are made so as to simulate different bottle sizes and shapes (as illustrated in FIG. 9). 14 weighted test rigs in total are used and rig conversion weights are used to simulate bottles of the following capacities: 2, 2.5, 3, 3.5 or 4 liters.

An expert panel is used in the testing, such comprises 12 people selected to have a wide diversity of hand sizes, shapes, finger nail length and grip strength, as well as a diversity in age (from 19 to 70 years of age). The selection is based on anthropometric measurements which include: hand length, hand width, finger grip diameter, square edge grip, grip strength and stature.

Each panelist is asked to test each handle and pick a favorite for lifting, pouring and overall favorite grip based on comfort. Lifting is done from high and low shelves as well as from table height. Each of the handles are tested with each of the weighted test rigs. For each of the weighted test rigs, each panelist chooses the preferred handle and choices are recorded.

Figure 10:
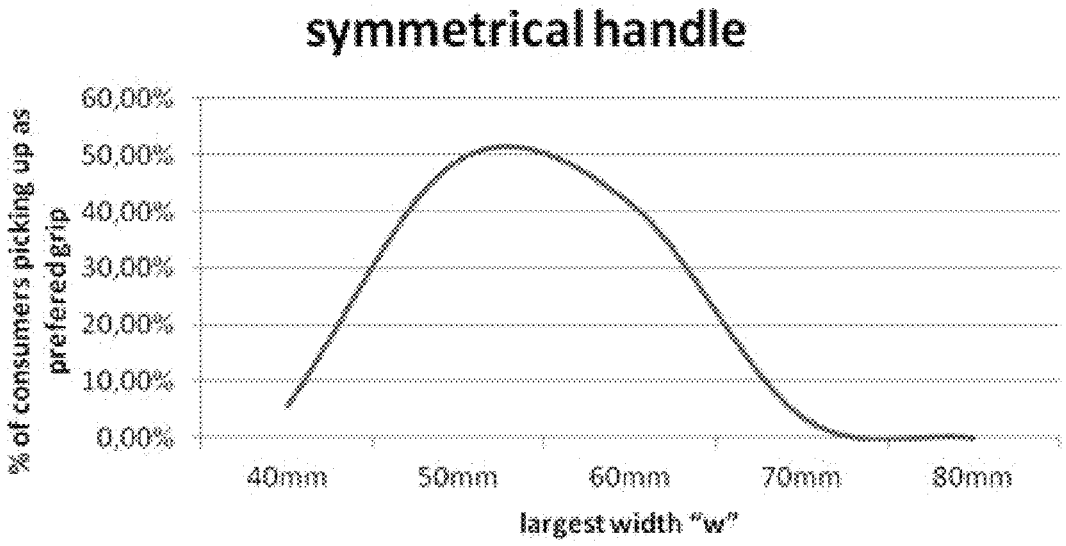
FIG. 10 illustrates total % of panelist preference for handles having a width "w".
Figure 10:
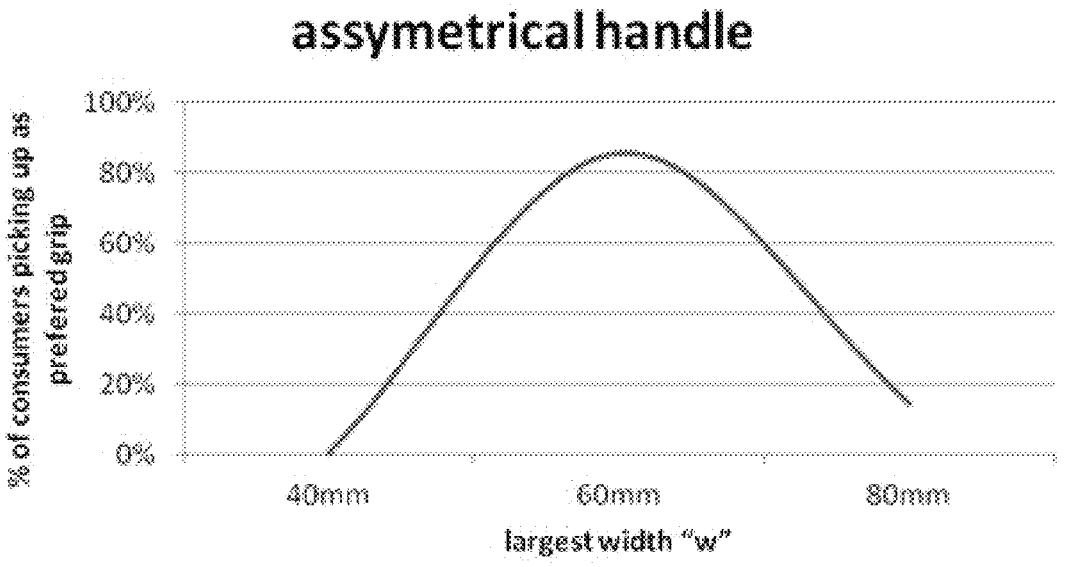

FIG. 10 illustrates the results of this test for both symmetric and asymmetric handles. The graph shows the total % of panelists preference for handles having a specific width "w" amongst all of the shapes and weighted test rigs tested.

Figure 11:
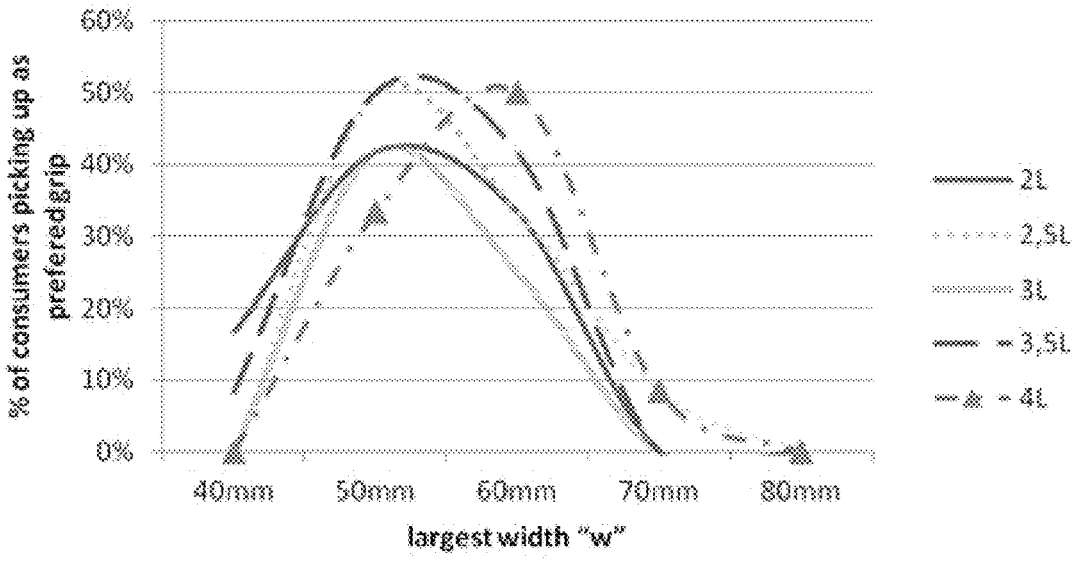
FIG. 11 illustrates total % of panelist preference for symmetric handles of width "w" and bottle size.

FIG. 11 illustrates the total % of panelist preference for symmetric handles of width "w" for each of the weighted test rigs.

EXAMPLES

Example 1

A standard PET resin (Equipolymer C88, IV=0.76 dl/g) perform is stretch-blow moulded at a mold temperature of 65° C. to form a 3 L bottle. The resulting intermediate container is transferred from the blow cavity to the second cavity by direct container transfer within the same machine. The gripping region in the intermediate container is maintained at a temperature between 40 and 60° C. The intermediate container is pressurized in the second cavity to 20 bar and the grip is formed using stepping motor controlled pistons. The pistons match the final grip shape. The piston and the second cavity are cooled at 6° C. The container is vented and then ejected when the grip section reaches room temperature (21° C.).

Table 1 shows the dimensions of containers made by the process of example 1.

TABLE 1

| Feature | Example A | Example B | Example C |
|---|---|---|---|
| Radius "r" | 27 mm | 19 mm | 18 mm |
| Width "w" | 60 mm | 55 mm | 53 mm |
| Angle "a" | 71° | 75° | 80° |
| Height "H" | 206 mm | 200 mm | 210 mm |
| Total grip circumference | 211 mm | 215 mm | 218 mm |
| Distance "d" | 24 mm | 25 mm | 26 mm |
| Height of semi-enclosed recess of holding means (greater than 90 mm) | 97 mm | 100 mm | 99 mm |
| First and second angles of the convex surface | First angle: 90° Second angle: 70° | First angle: 92° Second angle: 75° | First angle: 94° Second angle: 72° |
| Angle θ | 45° | 45° | 45° |
| Liters of content | 3 L | 3 L | 2.5 L |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A blow molded article for containing at least about 1.5 liters of a detergent composition, said article comprising:

a. a body having a top and a bottom;

b. an opening proximal to said top; and c. a non-through holding means integrally located on at least one side of said body and positioned between said top and said bottom, said holding means comprising at least one innermost surface, one external surface and at least one transition surface positioned between said innermost surface and said external surface, said holding means forming at least one semi-enclosed recess positioned between said external surface and said body, wherein, the cross-section of said holding means is rounded such that a radius "r" is formed between said transition surface and said external surface, said radius "r" being greater than about 7.5 mm, and wherein the largest width "w" of said holding means is between about 50 mm and about 60 mm, said holding means comprising a top surface extending at an angle "a" of greater than or equal to about 50° taken from the axis crossing the top and the bottom of the body; and wherein a primary grip position of said holding means is at a height "H" between about 1.3 and about 1.6 times the height of the center of gravity, measured at filled conditions, taken from said bottom.

2. A blow molded article for containing at least about 1.5 liters of a detergent composition, said article comprising:

a. a body having a top and a bottom;

b. an opening proximal to said top; and c. a non-through holding means integrally located on at least one side of said body and positioned between said top and said bottom, said holding means comprising at least one innermost surface, one external surface and at least one transition surface positioned between said innermost surface and said external surface, said holding means forming at least one semi-enclosed recess positioned between said external surface and said body, wherein, the cross-section of said holding means is rounded such that a radius "r" is formed between said transition surface and said external surface, said radius "r" being greater than about 7.5 mm, and wherein the largest width "w" of said holding means is between about 50 mm and about 60 mm, said holding means comprising a top surface extending at an angle "a" of greater than or equal to about 50° taken from the axis crossing the top and the bottom of the body; and wherein a total grip circumference is formed by the sum of all said innermost surfaces, external surface, and transition surfaces, and is at least about 190 mm.

3. A blow molded article for containing at least about 1.5 liters of a detergent composition, said article comprising:

a. a body having a top and a bottom;

b. an opening proximal to said top; and c. a non-through holding means integrally located on at least one side of said body and positioned between said top and said bottom, said holding means comprising at least one innermost surface, one external surface and at least one transition surface positioned between said innermost surface and said external surface, said holding means forming at least one semi-enclosed recess positioned between said external surface and said body, wherein, the cross-section of said holding means is rounded such that a radius "r" is formed between said transition surface and said external surface, said radius "r" being greater than about 7.5 mm, and wherein the largest width "w" of said holding means is between about 50 mm and about 60 mm, said holding means comprising a top surface extending at an angle "a" of greater than or equal to about 50° taken from the axis crossing the top and the bottom of the body; and wherein a distance "d" between an apex of said innermost surface and a distal end on said external surface is between about 0 mm and about 60 mm.

4. A blow molded article according to claim 3 wherein a distance "d" is between about 10 mm and about 50 mm.

5. A blow molded article for containing at least about 1.5 liters of a detergent composition, said article comprising:

a. a body having a top and a bottom;

b. an opening proximal to said top; and c. a non-through holding means integrally located on at least one side of said body and positioned between said top and said bottom, said holding means comprising at least one innermost surface, one external surface and at least one transition surface positioned between said innermost surface and said external surface, said holding means forming at least one semi-enclosed recess positioned between said external surface and said body, wherein, the cross-section of said holding means is rounded such that a radius "r" is formed between said transition surface and said external surface, said radius "r" being greater than about 7.5 mm, and wherein the largest width "w" of said holding means is between about 50 mm and about 60 mm, said holding means comprising a top surface extending at an angle "a" of greater than or equal to about 50° taken from the axis crossing the top and the bottom of the body; and wherein said semi-enclosed recess, is elongate in shape, and has a height of at least about 90 mm taken along the longest dimension thereof.

* * * * *